US009575450B2

(12) United States Patent
Mamura

(10) Patent No.: US 9,575,450 B2
(45) Date of Patent: Feb. 21, 2017

(54) SHEET TYPE DETECTION DEVICE THAT ENSURES REDUCED TROUBLE FOR UNEXECUTED SHEET TYPE SETTING, SHEET TYPE DETECTION METHOD, IMAGE FORMING APPARATUS, AND RECORDING MEDIUM

(71) Applicant: Kyocera Document Solutions Inc., Osaka (JP)

(72) Inventor: Toshiki Mamura, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/979,555

(22) Filed: Dec. 28, 2015

(65) Prior Publication Data

US 2016/0187826 A1 Jun. 30, 2016

(30) Foreign Application Priority Data

Dec. 26, 2014 (JP) ..... 2014-264106

(51) Int. Cl.
*G03G 15/00* (2006.01)

(52) U.S. Cl.
CPC ..... *G03G 15/5029* (2013.01); *G03G 15/5062* (2013.01); *G03G 2215/00738* (2013.01)

(58) Field of Classification Search
USPC ..... 399/38, 42, 45, 389; 358/1.18, 1.9, 3.23
See application file for complete search history.

(56) References Cited

U.S. PATENT DOCUMENTS

| | | | | |
|---|---|---|---|---|
| 7,382,992 | B2 * | 6/2008 | Takeda | G03G 15/6591 399/389 |
| 8,238,771 | B2 * | 8/2012 | Murakami | G03G 15/5029 399/45 |
| 8,363,269 | B2 * | 1/2013 | Obata | H04N 1/00867 358/1.18 |
| 8,570,589 | B2 * | 10/2013 | Togami | G03G 15/5029 347/15 |
| 8,626,013 | B2 * | 1/2014 | Matsui | G03G 15/5029 399/45 |
| 2014/0306399 | A1 * | 10/2014 | Nickerson | B65H 3/0638 271/109 |

FOREIGN PATENT DOCUMENTS

| | | |
|---|---|---|
| JP | H07-015586 A | 1/1995 |
| JP | 2001-301273 A | 10/2001 |

* cited by examiner

*Primary Examiner* — Hoan Tran
(74) *Attorney, Agent, or Firm* — James Judge

(57) ABSTRACT

A sheet type detection device includes an image reading circuit, a surface property determination circuit, a thickness determination circuit, and a sheet type identifying circuit. The image reading circuit reads a document image to generate image data. The surface property determination circuit determines a sheet surface condition of a sheet type detection target based on the image data generated by the image reading circuit. The thickness determination circuit determines a sheet thickness of the sheet based on the image data generated by the image reading circuit. The sheet type identifying circuit identifies a sheet type based on the determination result of the surface property determination circuit and the determination result of the thickness determination circuit.

9 Claims, 5 Drawing Sheets

SHEET TYPE DETECTION DEVICE THAT ENSURES REDUCED TROUBLE FOR UNEXECUTED SHEET TYPE SETTING, SHEET TYPE DETECTION METHOD, IMAGE FORMING APPARATUS, AND RECORDING MEDIUM

INCORPORATION BY REFERENCE

This application is based upon, and claims the benefit of priority from, corresponding Japanese Patent Application No. 2014-264106 filed in the Japan Patent Office on Dec. 26, 2014, the entire contents of which are incorporated herein by reference.

BACKGROUND

Unless otherwise indicated herein, the description in this section is not prior art to the claims in this application and is not admitted to be prior art by inclusion in this section.

An image forming apparatus such as a copier, a facsimile, and a multi-functional peripheral forms an image on a sheet (recording medium) during conveying. These sheets are available in various types, and sheets different in, for example, material, surface property, and thickness are used. Thus, while a satisfactory image formation quality may be obtained due to using a specific-type sheet, an image formation quality may deteriorate due to using the other-type sheet. For example, when an image formation is performed on a sheet having large unevenness on its surface under an image formation condition optimized for a sheet having a little unevenness on its surface, a recording material moves into concave portions. This consequently and becomes prone to exposure of the sheet surface at which the recording material should present.

To solve this type of problem, a configuration where a user specifies a sheet type to be used in advance is widely employed. However, a low-quality printed matter is often output because the user forgets to specify a sheet type. Thus, an image forming apparatus having a function of detecting a sheet type is proposed.

For example, one print apparatus is proposed. This print apparatus includes: a sensor unit including a light emitting element irradiating a paper sheet, and a detecting element receiving a light reflected by a surface of the paper sheet, and determines, for example, a surface shape of the paper sheet and a resolution from a detection signal of the detecting element.

Additionally, another image forming apparatus is proposed. This print apparatus includes a paper thickness detection roller located in, for example, a sheet conveying path, and identifies a paper sheet thickness from a displacement amount of the paper thickness detection roller pushed up by a paper sheet passing via immediately below the paper thickness detection roller.

SUMMARY

A sheet type detection device according to one aspect of the disclosure includes an image reading circuit, a surface property determination circuit, a thickness determination circuit, and a sheet type identifying circuit. The image reading circuit reads a document image to generate image data. The surface property determination circuit determines a sheet surface condition of a sheet type detection target based on the image data generated by the image reading circuit. The thickness determination circuit determines a sheet thickness of the sheet based on the image data generated by the image reading circuit. The sheet type identifying circuit identifies a sheet type based on the determination result of the surface property determination circuit and the determination result of the thickness determination circuit.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
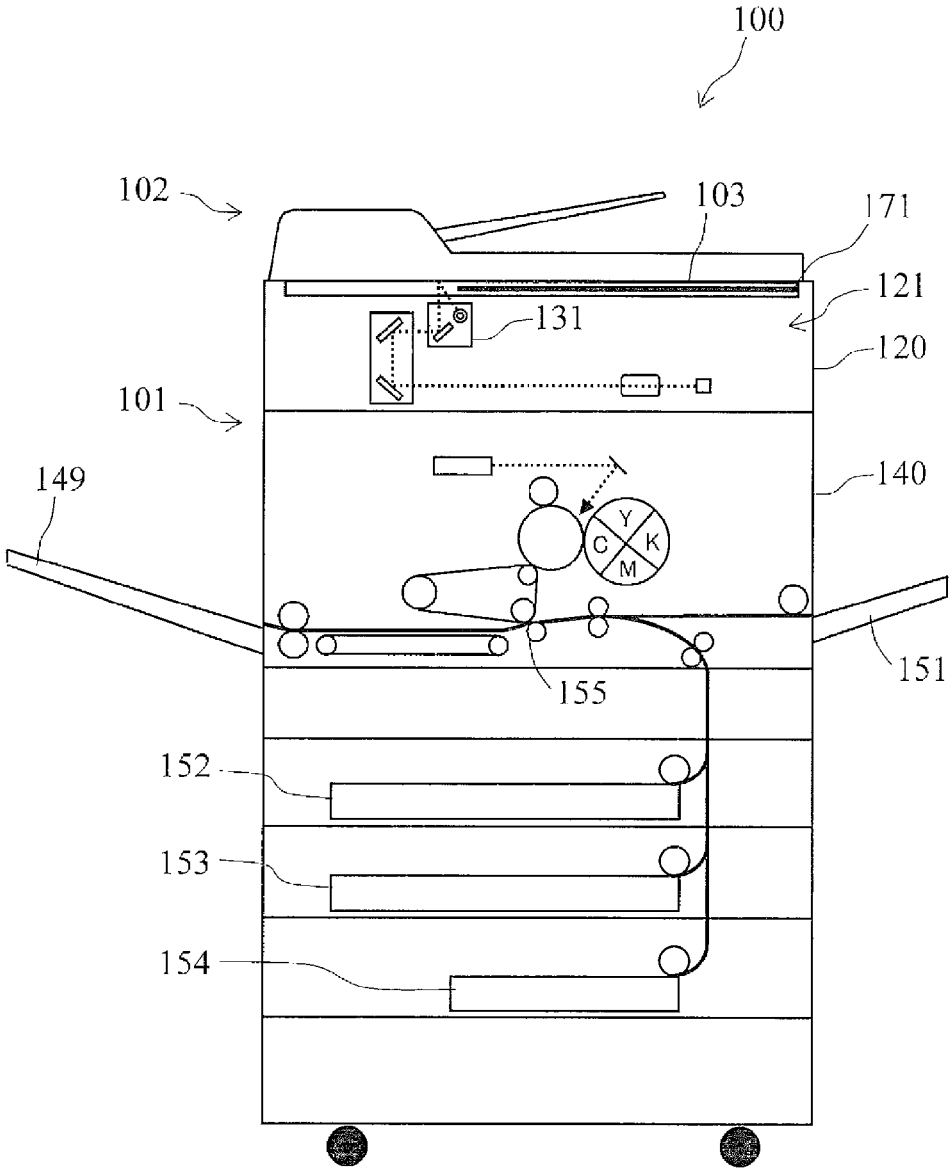
FIG. 1 schematically illustrates an overall configuration of a multi-functional peripheral according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes one embodiment of the disclosure in more detail with reference to the drawings. The following embodies the disclosure as a digital multi-functional peripheral.

FIG. 1 schematically illustrates an exemplary of an overall configuration of a digital multi-functional peripheral according to one embodiment. As illustrated in FIG. 1, a multi-functional peripheral 100 includes a main body 101, which includes an image reading unit 120 (which is also referred to as an image reading circuit) and an image forming unit 140, and a platen cover 102 installed on an upper side of the main body 101. A platen 103 made of a transparent plate such as a contact glass is located at a top surface of the main body 101. The platen 103 is opened or closed due to an open/close of the platen cover 102. This platen cover 102 includes a white plate (a surface facing the platen 103) on its back surface. An operation panel 171 is located at a front surface of the multi-functional peripheral 100. A user can give an instruction of a start of copying or other instructions to the multi-functional peripheral 100, and confirms a state and a setting of the multi-functional peripheral 100 using the operation panel 171.

The image reading unit 120 is located below the platen 103. The image reading unit 120 reads an image of an original document using a scanning optical system 121 to generate digital data of its image (image data). In the embodiment, a document image is obtained due to a movement of a carriage 131 in a sub-scanning direction (a lateral direction in the drawing). The image reading unit 120 generates the image data of the original document corresponding to respective colors, for example, R (red), G (green), and B (blue).

The generated image data can be printed on a paper sheet (sheet) at the image forming unit 140. The generated image data can be transmitted to another apparatus via, for example, a network interface (not illustrated) and via a network.

The image forming unit 140 prints image data generated by the image reading unit 120 and image data received from another apparatus via a network (not illustrated) on paper sheet. The image forming unit 140 feeds a paper sheet from, for example, a bypass tray 151 and sheet feed cassettes 152, 153, and 154 to a transfer unit 155 that transfers a toner image. A paper sheet on which a toner image has been transferred by the transfer unit 155 is discharged to a sheet discharge tray 149.

Figure 2:
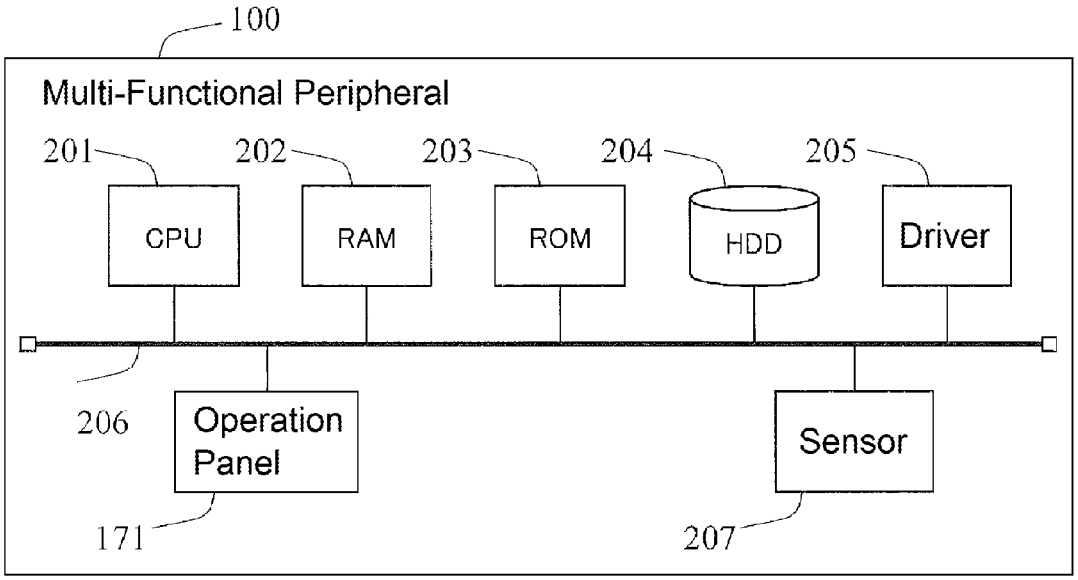
FIG. 2 illustrates a hardware configuration of the multi-functional peripheral according to the one embodiment.

FIG. 2 illustrates a control-system hardware configuration of a multi-functional peripheral. Drivers 205, which correspond to respective driving units of a central processing unit (CPU) 201, a random access memory (RAM) 202, a read only memory (ROM) 203, a hard disk drive (HDD) 204, the image reading unit 120, and the image forming unit 140, are connected via an internal bus 206 in the multi-functional peripheral 100 of the embodiment. The ROM 203 and the HDD 204, which are non-transitory recording mediums, for example, store programs, and the CPU 201 controls the multi-functional peripheral 100 in accordance with a command of a control program among the programs. For example, the CPU 201 uses the RAM 202 as a work area, and transmits and receives data and an instruction between the drivers 205 to control an operation of the respective driving units described above. The HDD 204 is additionally used for accumulation of image data obtained from the image reading unit 120 and image data received from another apparatus via a network.

The internal bus 206 additionally connects to the operation panel 171 and various kinds of sensors 207. The operation panel 171 accepts a user operation, and then supplies a signal based on its operation to the CPU 201. The operation panel 171 displays an operation screen on a touch panel display, which the operation panel 171 itself includes, in accordance with a control signal from the CPU 201. The sensor 207 includes various kinds of sensors such as an open/close detection sensor for the platen cover 102, a detection sensor for an original document on the platen 103, a temperature sensor for a fixing unit, and a detection sensor for a paper sheet to be conveyed or an original document.

For example, execution of the program stored on the ROM 203 causes the CPU 201 to ensure the following respective units (function block) and, control operations of the respective units corresponding to a signal from these sensor.

Figure 3:
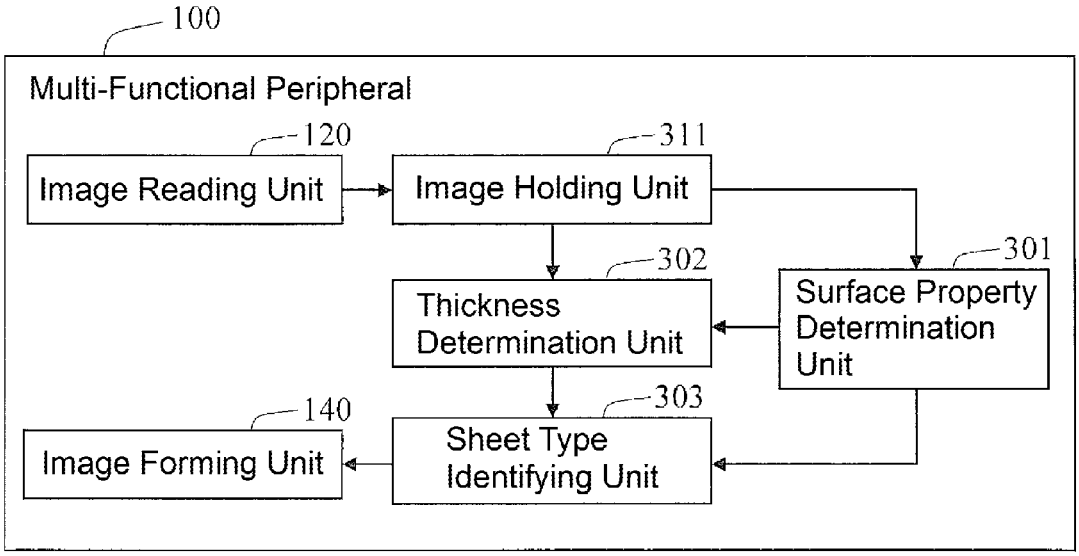
FIG. 3 illustrates the multi-functional peripheral according to the one embodiment.

FIG. 3 illustrates the multi-functional peripheral of the embodiment. As illustrated in FIG. 3, the multi-functional peripheral 100 includes a surface property determination unit 301, a thickness determination unit 302, and a sheet type identifying unit 303. The surface property determination unit 301 is also referred to as a surface property determination circuit. The thickness determination unit 302 is also referred to as a thickness determination circuit. The sheet type identifying unit 303 is also referred to as a sheet type identifying circuit.

The surface property determination unit 301 determines a sheet surface condition of a sheet as a sheet type detection target based on the image data generated by the image reading unit 120. In the embodiment, the surface property determination unit 301 determines a sheet surface condition when the user selects a sheet type detecting mode as described below.

Not specifically limited, in the embodiment, an image holding unit 311 temporarily holds image data obtained by the image reading unit 120. Here, the RAM 202 functions as a storage region of the image holding unit 311. When the user selects the sheet type detecting mode, the image reading unit 120 obtains: image data at a region corresponding to a sheet placed on the platen 103, and image data at a region adjacent to a sheet edge and a region where a sheet does not exist (edge adjacent region adjacent to an edge outside a sheet) to hold the image data in the image holding unit 311. Namely, when the sheet as the sheet type detection target is placed on the platen 103, the image reading unit 120 detects a sheet size using any known method to obtain image data at a region where a sheet does not exist in addition to a region corresponding to this detected size. The region where a sheet does not exist includes: a sheet edge adjacent region described below (a region adjacent to a sheet edge and a region where a sheet does not exist), and a region without a sheet.

Figure 4A:
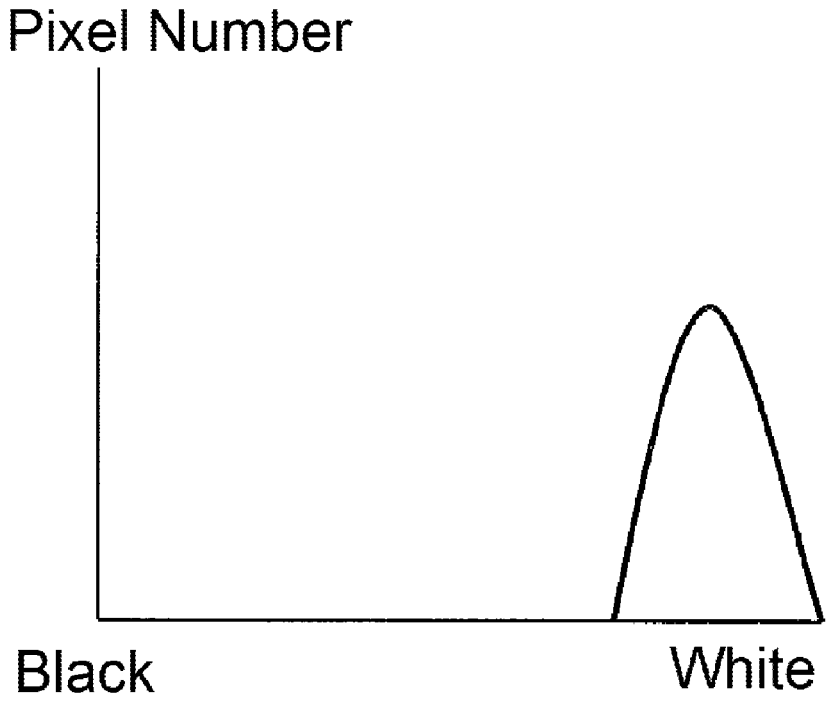
FIGS. 4A to 4B schematically illustrate a determination method of a sheet surface property according to the one embodiment.
Figure 4B:
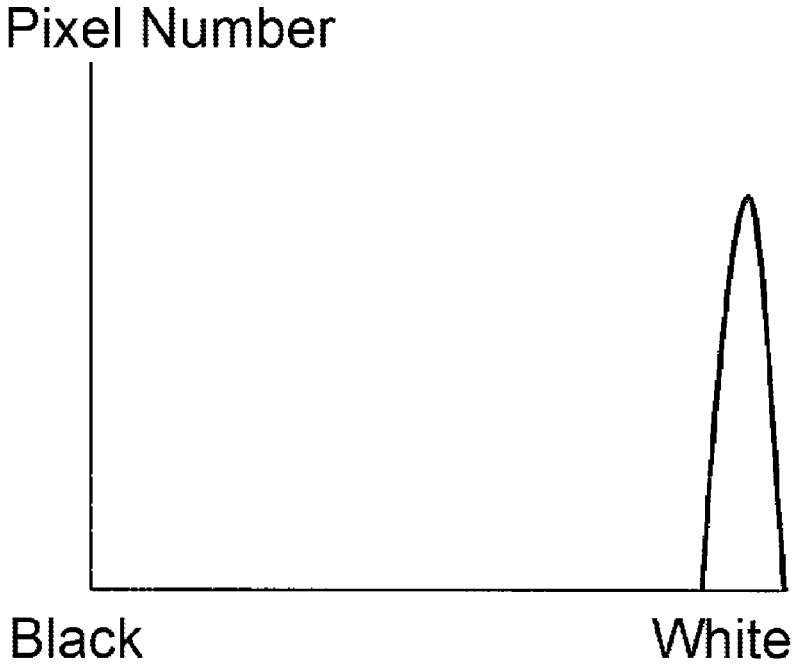

Not specifically limited, in the embodiment, the surface property determination unit 301 determines a sheet surface condition based on a pixel value distribution of respective pixels in image data of the sheet held in the image holding unit 311. FIGS. 4A and 4B schematically illustrate a determination method of a sheet surface condition (surface property) performed by the surface property determination unit 301. Here, a sheet is assumed to be white.

When determining a sheet surface condition, the surface property determination unit 301 totalizes pixel values of the respective pixels in a region corresponding to the sheet held in the image holding unit 311 to perform histogram processing. FIGS. 4A to 4B illustrate results of the histogram processing. FIG. 4A corresponds to a sheet having a relatively coarse surface condition. FIG. 4B corresponds to a sheet having a relatively smooth surface condition. In FIGS. 4A and 4B, the horizontal axis corresponds to a pixel value when expressing in monochrome (grayscale). For example, in the case of 256 tones, black is 0, and white is 255. The vertical axis corresponds to a frequency of the pixel (pixel number) having respective pixel values.

In the embodiment, the respective pixels have pixel values corresponding to the respective colors, the R (red), the G (green), and the B (blue) since the image reading unit 120 generates image data corresponding to the respective colors, the R, the G, and the B. Here, the sheet is white. This causes an approximately identical pixel value of the respective colors. Thus, the histogram processing can be performed using an element value of any one color (for example, the R). The histogram processing can be performed using a pixel value performed a monochrome conversion from respective element values of the R, the G, and the B using a known weighted average method.

When the sheet surface is coarse, and is irradiated with a light to read the image, shadows appear on the sheet surface due to unevenness of the surface. In this case, a distribution width of the pixel value expands as illustrated in FIG. 4A. On the other hand, when the sheet surface is smooth, and is irradiated with a light to read the image, shadows do not appear on the sheet surface because of the surface without unevenness. In this case, a distribution width of pixel value narrows as illustrated in FIG. 4B. The surface property determination unit 301 of the embodiment determines the sheet surface classified into five levels from a sheet surface property with gloss (the surface is smooth) to the sheet surface property without gloss (the surface is coarse) based on this distribution width size.

The thickness determination unit 302 determines a sheet thickness of the sheet as the sheet type detection target based on the image data generated by the image reading unit 120. The thickness determination unit 302 determines the sheet thickness when the user selects a sheet type detecting mode similarly to the surface property determination unit 301. Not specifically limited, the thickness determination unit 302 of the embodiment determines the sheet thickness based on the pixel value of the respective pixels of the image data adjacent to an edge of the sheet and in the state where a sheet does not exist, held in the image holding unit 311.

Figure 5:
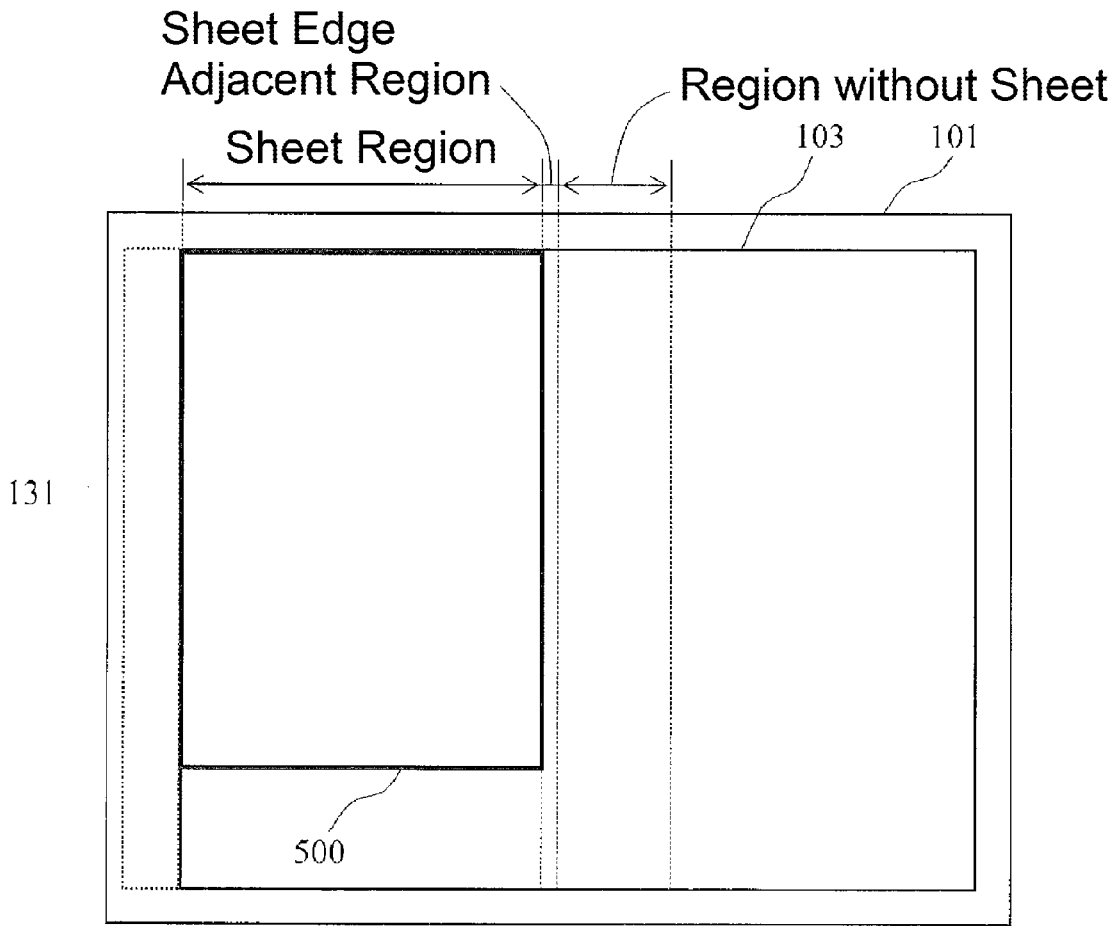
FIG. 5 schematically illustrates a sheet thickness determination method according to the one embodiment.

FIG. 5 schematically illustrates a sheet thickness determination method performed by the thickness determination unit 302. FIG. 5 corresponds to a plan view of the multi-functional peripheral 100. In FIG. 5, an illustration of the platen cover 102 is omitted due to the description.

When the sheet type detecting mode is selected, the user places a sheet 500 as the sheet type detection target on the platen 103. A home position of the carriage 131 in the image reading unit 120 is at a left side of the platen 103 in FIG. 5 as illustrated by a dotted line in FIG. 5. Thus, the user places the sheet 500 on an end portion of a home position side of the platen 103.

Here, as illustrated in FIG. 5, a sheet region denotes a region where the sheet 500 exists on the platen 103 in the sub-scanning direction (a lateral direction in FIG. 5), which is a movement direction of the carriage 131. The sheet edge adjacent region denotes a region adjacent to an edge of the sheet 500 and a region where a sheet does not exist. Furthermore, the region without a sheet denotes a region that is farther from the home position of the carriage 131 than the sheet edge adjacent region. Here, the region without a sheet is a region that the platen cover 102 contacts the platen when the platen cover 102 is closed. Additionally, the sheet edge adjacent region is a region having a gap between a back surface of the platen cover 102 and the platen 103 due to the sheet thickness when the platen cover 102 is closed.

The platen cover 102 contacts the platen 103 in the region without a sheet. Thus, image data held in the image holding unit 311 includes pixels corresponding to the back surface of the platen cover 102 (here, white plate). Existence of the gap between the platen cover 102 and the platen 103 in the sheet edge adjacent region causes inclusion of blacker pixels than the region without a sheet. Consequently, the sheet edge adjacent region includes a pixel having a smaller pixel value (blacker pixel) as the sheet thickness is thick.

The thickness determination unit 302 of the embodiment determines the sheet thickness classified into three levels, light, normal, and thick, based on differences between pixel values of pixels included in the sheet edge adjacent region of the image data and pixel values of pixels included in the region without a sheet, held in the image holding unit 311. The sheet edge adjacent region can be identified by detecting an end portion of the sheet 500 and an end portion of a home position side of the region without a sheet in a sub-scanning direction of the image data, held in the image holding unit 311.

The above-description has described the sub-scanning direction of the carriage 131. However, when a length of the main-scanning direction of the sheet 500 is smaller than a length of the main-scanning direction of the platen 103, a similar thickness determination can be performed in the main-scanning direction.

The sheet type identifying unit 303 identifies the sheet type based on the determination result of the surface property determination unit 301 and the determination result of the thickness determination unit 302. For example, the sheet types are identified as respective combinations when the sheet surface property is classified into a plurality of levels (for example, five levels), from glossy to mat, and the sheet thickness is classified into a plurality of levels (for example, three levels). When the sheet surface property is classified into five levels, and the sheet thickness is classified into three levels, the sheet type consequently has a fifteen-level classification.

In the embodiment, the identified sheet type is registered, correspondingly to paper feeding positions (the bypass tray 151 and the sheet feed cassettes 152, 153, and 154) of the multi-functional peripheral 100, in the image forming unit 140. When a paper sheet is fed from the bypass tray 151 and the sheet feed cassettes 152, 153, and 154, the image forming unit 140 changes, for example, a development potential to develop an electrostatic latent image formed on a photoreceptor drum, a transfer potential of the transfer unit 155, and a fixing temperature of the fixing unit in accordance with the registered sheet type. This causes the performance of the image formation to be in an appropriate condition corresponding to a sheet type.

Figure 6:
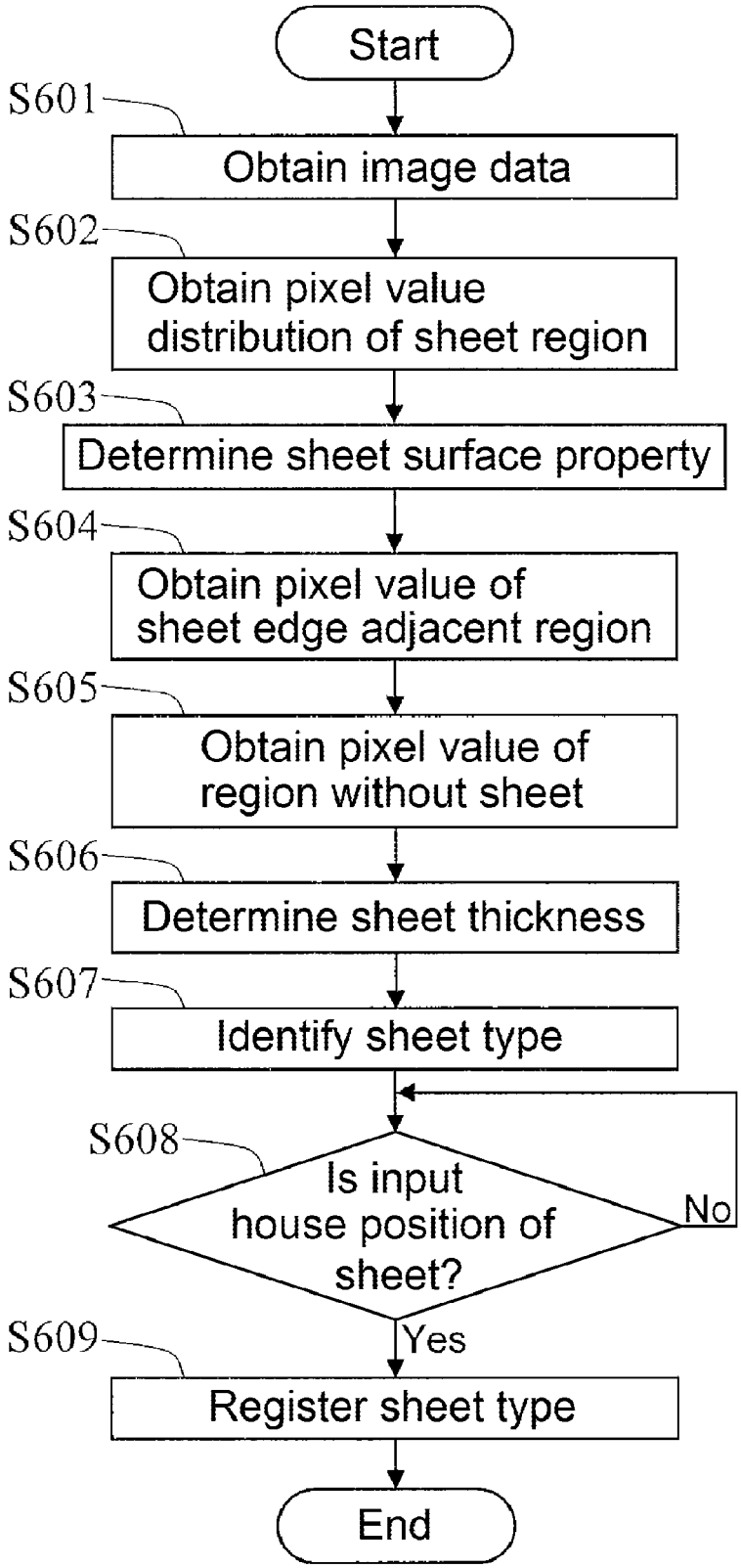
FIG. 6 illustrates an example of a sheet type determination procedure executed by the multi-functional peripheral according to the one embodiment.

FIG. 6 illustrates an example of a sheet type determination procedure performed by the multi-functional peripheral 100. This procedure starts, for example, with a start instruction of the sheet type detecting mode for determining a sheet type input by the user via the operation panel 171 as a trigger.

When this procedure start, first, the user places the sheet as the sheet type detection target on the platen 103, and then instructs the image reading unit 120 to obtain image data by, for example, a pressing down a start button included in the operation panel 171 (Step S601). The image reading unit 120 obtains image data at a region corresponding to the sheet placed on the platen 103 and image data at a region where a sheet does not exist (the sheet region described above, the sheet edge adjacent region described above, and the region without a sheet described above) to hold the image data in the image holding unit 311 in response to this instruction.

After the image reading unit 120 completes storage of the image data in the image holding unit 311, the surface property determination unit 301 totalizes pixel values of the respective pixels included in the image data, held in the image holding unit 311, of the above-described sheet region to perform histogram processing (Step S602). Then, the surface property determination unit 301 determines a sheet surface property using the method described above (Step S603). The surface property determination unit 301 notifies the sheet type identifying unit 303 of a determination result and, notifies the thickness determination unit 302 of a notice that its sheet surface property determination is completed.

The thickness determination unit 302 identifies a sheet edge adjacent region of the image data, held in the image holding unit 311, corresponding to this notification as described above, to obtain pixel values of specific pixels (for example, the blackest pixel and a pixel that is at a position separated from the sheet edge by a specific pixel number) included in the sheet edge adjacent region (Step S604). The thickness determination unit 302 additionally obtains pixel values of the region without a sheet (pixel values of pixels at a specific position and an average value of pixel values of a plurality of pixels) (Step S605). Then, the thickness determination unit 302 determines a sheet thickness using the method described above (Step S606). The thickness determination unit 302 notifies the sheet type identifying unit 303 of the determination result.

The sheet type identifying unit 303 identifies a sheet type using the method described above in response to the notification from the thickness determination unit 302 (Step S607). After querying a position of a sheet feed cassette housing a sheet as the sheet type detection target via a display included in the operation panel 171, the sheet type identifying unit 303, which has identified the sheet type, waits until the user specifies it (No at Step S608). Not specifically limited, here, the sheet type identifying unit 303 displays a selection button to select any of the bypass tray 151, and the sheet feed cassettes 152, 153, and 154 on the display on the operation panel 171. After the user inputs a position of the sheet feed cassette, the sheet type identifying unit 303 registers the identified sheet type as a sheet type of the sheet housed in the specified sheet feed cassette in the image forming unit 140 (Yes at Step S608 and S609).

When a paper sheet is fed from the bypass tray 151 and the sheet feed cassettes 152, 153, and 154, the image forming unit 140 changes, for example, a development potential to develop an electrostatic latent image formed on a photoreceptor drum, a transfer potential of the transfer unit 155, and a fixing temperature of the fixing unit in accordance with the registered sheet type.

The embodiment described above has exemplified a configuration where the thickness determination unit 302 determines a sheet thickness based on differences between pixel values of pixels included in the sheet edge adjacent region and pixel values of pixels included in the region without a sheet as an especially preferable configuration. However, a configuration where the thickness determination unit 302 determines the sheet thickness without using the pixel value of the pixel included in the region without a sheet may be employed. For example, the thickness determination unit 302 may determine the sheet thickness using differences between the pixel values of the pixels included in the sheet edge adjacent region and pixel values of white pixels, or only the pixel values of the pixels included in the sheet edge adjacent region.

A size of the sheet edge adjacent region described above increases as the sheet thickness increases. Thus, for example, a configuration where the thickness determination unit 302 determines the sheet thickness based on the width of the sub-scanning direction of the sheet edge adjacent region may be employed. In this case, the width of the sub-scanning direction of the sheet edge adjacent region may be detected by detection of the end portion of the sheet 500 and the home position side end portion of the region without a sheet in the sub-scanning direction of the image data held in the image holding unit 311.

As described above, the multi-functional peripheral 100 identifies a sheet type by an image reading using the image reading unit 120 to register the sheet type. This eliminates the need for a special sensor or similar unit for detecting sheet type, for example, in a sheet conveyance path or the sheet feed cassettes 152, 153, or 154. This ensures a correct determination of a sheet type at a comparatively low cost, a reduced troublesome setting for a sheet type by the user, and a reduced unanticipated trouble for an unexecuted sheet type setting.

The above-described embodiment does not limit the technical scope of the disclosure. Various modifications and applications are possible within the scope of the disclosure in addition to the above-described embodiments. While in the embodiment described above the surface property determination unit 301 determines a sheet surface property based on pixel values of a monochrome image, the surface property determination unit 301 may additionally obtain a background color of the sheet as a sheet type. The background color of such a sheet can be recognized easily based on pixel values of a color image such as the R, the G, and the B. Considering the background color of the sheet as the sheet type ensures, for example, an additional execution of a tint adjustment when a color image is formed on this sheet.

The embodiment described above has exemplified a configuration where the sheet as the sheet type detection target is placed on the platen 103. However, insofar as at least image data of the sheet region described above and image data of the sheet edge adjacent region are obtainable, the embodiment described above may include a configuration where the image reading unit 120 obtains image data of the sheet as the sheet type detection target using an automatic document feeder (ADF).

An order of respective steps of a flowchart illustrated in FIG. 6 are appropriately changeable within a range providing equivalent operations. For example, an execution order of processes executed by the surface property determination unit 301 (Step S602 and S603) and processes executed by the thickness determination unit 302 (Step S604, S605, and S606) may be reversed, or these processes can be executed in parallel.

Furthermore, the embodiment described above has embodied the disclosure as a digital multi-functional peripheral; however, this is not limited to the digital multi-functional peripheral. The disclosure is applicable to any image forming apparatus including an image reading unit such as a copier. Additionally, the disclosure can provide a sheet type detection device including an image reading unit, a surface property determination unit, a thickness determination unit, and a sheet type identifying unit.

The disclosure ensures a correct determination of a sheet type at a comparatively low cost, a reduction of a troublesome setting for a sheet type by the user, and a reduced unanticipated trouble for an unexecuted sheet type setting, and is effective as a sheet type detection device and an image forming apparatus. The disclosure additionally solves the problem included in the configuration as described below.

The configuration, which obtains a surface condition of a paper sheet during conveying, ensures detection of a paper sheet type in real-time. However, a distance between a surface of a paper sheet and a sensor unit or an angle between a surface of a paper sheet and a sensor unit varies due to: waviness in the paper sheet generated during conveying in a sheet conveyance path, and/or location position accuracies of a light emitting element and a detecting element. This may cause a reflected light not to enter the detecting element under an identical condition, and then cause erroneous detection.

The configuration, which includes a sensor unit located in a sheet feed cassette, which houses a paper sheet, to obtain a surface condition of a paper sheet before discharging the paper sheet from the sheet feed cassette and includes many sheet feed cassettes, increases the cost of an apparatus because the number of required sensor units increases.

Assume that a configuration detects a paper thickness based on a physical contact between a paper sheet and a paper thickness detection roller. If the paper thickness detection roller is abraded, the configuration detects thinner than an actual thickness. Additionally, when a foreign object such as paper dust is located between the paper sheet and the paper thickness detection roller, the configuration detects thicker than an actual thickness. Namely, these configurations possibly cause erroneous detection.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sheet type detection device, comprising:

an image reading circuit that reads a document image to generate image data;

a surface property determination circuit that determines a sheet surface condition of a sheet type detection target based on the image data generated by the image reading circuit;

a thickness determination circuit that determines a sheet thickness of the sheet based on the image data generated by the image reading circuit; and a sheet type identifying circuit that identifies a sheet type based on the determination result of the surface property determination circuit and the determination result of the thickness determination circuit; wherein the surface property determination circuit determines a sheet surface condition based on a pixel value distribution of respective pixels in the image data of the sheet.

2. An image forming apparatus, comprising:

the sheet type detection device according to claim 1; and an image forming unit that forms an image on a sheet based on a sheet type identified by the sheet type identifying circuit.

3. A method for detecting a sheet type, comprising:

reading a document image to generate image data;

determining a sheet surface condition of a sheet type detection target based on the image data generated;

determining a sheet thickness of the sheet based on the generated image data; and identifying a sheet type based on the determination results of the sheet surface condition and the sheet thickness; wherein determining the sheet surface condition is performed based on a pixel value distribution of respective pixels in the image data of the sheet.

4. A non-transitory computer-readable recording medium storing a sheet type detection program to control a sheet type detection device, the sheet type detection program causing the sheet type detection device to function as:

an image reading circuit that reads a document image to generate image data;

a surface property determination circuit that determines a sheet surface condition of a sheet type detection target based on the image data generated by the image reading circuit;

a thickness determination circuit that determines a sheet thickness of the sheet based on the image data generated by the image reading circuit; and a sheet type identifying circuit that identifies a sheet type based on the determination result of the surface property determination circuit and the determination result of the thickness determination circuit; wherein the surface property determination circuit determines a sheet surface condition based on a pixel value distribution of respective pixels in the image data of the sheet.

5. A sheet type detection device, comprising:

an image reading circuit that reads a document image to generate image data;

a surface property determination circuit that determines a sheet surface condition of a sheet type detection target based on the image data generated by the image reading circuit;

a thickness determination circuit that determines a sheet thickness of the sheet based on the image data generated by the image reading circuit; and a sheet type identifying circuit that identifies a sheet type based on the determination result of the surface property determination circuit and the determination result of the thickness determination circuit; wherein the thickness determination circuit determines the sheet thickness based on pixel values of respective pixels in the image data corresponding to a sheet edge adjacent region adjacent to an edge outside the sheet.

6. The sheet type detection device according to claim 5, further comprising:

a platen on which an original document is placed; and a platen cover that includes a white plate on a back surface thereof, and causes the platen to be openable/closable; wherein the sheet edge adjacent region adjacent to an edge outside the sheet is a region having a gap due to a thickness of the original document between the back surface of the platen cover and the platen when the platen cover is closed.

7. An image forming apparatus, comprising:

the sheet type detection device according to claim 5; and an image forming unit that forms an image on a sheet based on a sheet type identified by the sheet type identifying circuit.

8. A method for detecting a sheet type, comprising:

reading a document image to generate image data;

determining a sheet surface condition of a sheet type detection target based on the image data generated;

determining a sheet thickness of the sheet based on the generated image data; and identifying a sheet type based on the determination results of the sheet surface condition and the sheet thickness; wherein determining the sheet thickness is performed based on pixel values of respective pixels in the image data corresponding to a sheet edge adjacent region adjacent to an edge outside the sheet.

9. A non-transitory computer-readable recording medium storing a sheet type detection program to control a sheet type detection device, the sheet type detection program causing the sheet type detection device to function as:

an image reading circuit that reads a document image to generate image data;

a surface property determination circuit that determines a sheet surface condition of a sheet type detection target based on the image data generated by the image reading circuit;

a thickness determination circuit that determines a sheet thickness of the sheet based on the image data generated by the image reading circuit; and a sheet type identifying circuit that identifies a sheet type based on the determination result of the surface property determination circuit and the determination result of the thickness determination circuit; wherein the thickness determination circuit determines the sheet thickness based on pixel values of respective pixels in the image data corresponding to a sheet edge adjacent region adjacent to an edge outside the sheet.

* * * * *